US012245662B2

(12) United States Patent
Swigart

(10) Patent No.: US 12,245,662 B2
(45) Date of Patent: Mar. 11, 2025

(54) REGIONALLY TIME-DEPENDENT MIDSOLE

(71) Applicant: Acushnet Company, Fairhaven, MA (US)

(72) Inventor: John F. Swigart, Bridgewater, MA (US)

(73) Assignee: ACUSHNET COMPANY, Fairhaven, MA (US)

( * ) Notice: Subject to any disclaimer, the term of this patent is extended or adjusted under 35 U.S.C. 154(b) by 130 days.

(21) Appl. No.: 17/805,325

(22) Filed: Jun. 3, 2022

(65) Prior Publication Data

US 2023/0389646 A1 Dec. 7, 2023

(51) Int. Cl.

| | |
|---|---|
| ***A43B 5/00*** | (2022.01) |
| ***A43B 7/142*** | (2022.01) |
| ***A43B 7/143*** | (2022.01) |
| ***A43B 13/12*** | (2006.01) |
| ***A43B 13/18*** | (2006.01) |

(52) U.S. Cl.

CPC ..... *A43B 5/001* (2013.01); *A43B 7/142* (2013.01); *A43B 7/143* (2013.01); *A43B 13/125* (2013.01); *A43B 13/188* (2013.01)

(58) Field of Classification Search

None

See application file for complete search history.

(56) References Cited

U.S. PATENT DOCUMENTS 4,642,911 A * 2/1987 Talarico, II ..... A43B 13/12 36/142
7,191,552 B1 * 3/2007 Husom ..... A61F 5/14 36/144
7,712,231 B2 * 5/2010 Umezawa ..... A43B 13/125 36/144
2007/0033834 A1 * 2/2007 Cheskin ..... A43B 7/223 36/28
2012/0317841 A1 * 12/2012 Taylor ..... A43B 3/0084 36/103
2016/0219970 A1 * 8/2016 Jacob ..... A43B 17/02
2016/0360825 A1 * 12/2016 Pedersen ..... A43B 7/145
2017/0224048 A1 * 8/2017 Nagano ..... A43B 7/141
2021/0085020 A1 * 3/2021 Grever ..... A43B 7/144

FOREIGN PATENT DOCUMENTS

GB 2431334 A * 4/2007 ..... A43B 13/026
WO WO-2020013640 A1 * 1/2020 ..... A43B 7/1415

OTHER PUBLICATIONS

English Translation of WO2020/013640 (Year: 2020).*

* cited by examiner

*Primary Examiner* — Ted Kavanaugh
(74) *Attorney, Agent, or Firm* — Womble Bond Dickinson (US) LLP

(57) ABSTRACT

A golf shoe with a sole assembly having a regionally time-dependent midsole is provided. The midsole may include a lateral region constructed of a first material and a medial region constructed of a second material, where elastic properties of the lateral region and viscoelastic properties the medial region provide a neutral support platform when a relatively brief compression load is placed on the midsole (e.g., when a wearer is taking a step while walking), and further provide an everted supported platform when the compression load is placed on the midsole for a longer period of time (e.g., when the wearer is swinging a golf club).

18 Claims, 10 Drawing Sheets

MEDIAL VIEW

LATERAL VIEW

DORSAL VIEW

POSTERIOR VIEW

DORSAL VIEW

POSTERIOR VIEW

REGIONALLY TIME-DEPENDENT MIDSOLE

BACKGROUND

The sport of golf involves a variety of actions that a golfer may perform, such as a golf swing, walking a golf course, and other golfing actions. Having proper equipment when playing the sport of golf may be a factor in how well the golfer may be able to perform these actions. Golf shoes are one example piece of equipment that can affect a golfer's performance. For example, when a golfer swings a club and transfers their weight on their feet, there are high forces placed on the foot, and the shoe needs to accommodate and respond to those forces.

It is with respect to these and other general considerations that the aspects disclosed herein have been made. Also, although relatively specific problems may be discussed, it should be understood that the examples should not be limited to solving the specific problems identified in the background or elsewhere in this disclosure.

SUMMARY

Examples of the present disclosure describe a golf shoe including a regionally time-dependent midsole operative to provide a neutral support angle when a relatively brief compression load is placed on the midsole (e.g., when a wearer is taking a step while walking) and to further provide an everted support angle when the compression load is placed on the midsole for a longer period of time (e.g., when the wearer is swinging a golf club).

In one example, a golf shoe is provided including an upper; and a sole assembly connected to the upper, the sole assembly including: an outsole; and a midsole including: a lateral region constructed of a first material; and a medial region constructed of a second material, wherein: the first material compresses to a maximum compression of the first material within a first time period; and the second material compresses to the maximum compression of the first material within the first time period and compresses to a maximum compression of the second material within a second time period.

In another example, a regionally time-dependent midsole for a golf shoe is provided, the midsole including a lateral region constructed of a first material; and a medial region constructed of a second material, wherein when the midsole is under a load: the lateral region compresses to a maximum compression of the first material and the medial region compresses to the same maximum compression of the first material within a first time period; and the medial region compresses to a maximum compression of the second material within a second time period.

In another example, a method for making a golf shoe including a regionally time-dependent midsole for a golf shoe is provided, the method including constructing an upper; constructing an outsole; constructing a lateral region of a midsole using a first material; constructing a medial region of the midsole using a second material, wherein: the first material compresses to a maximum compression of the first material within a first time period; and the second material compresses to the maximum compression of the first material within the first time period and compresses to a maximum compression of the second material, higher than the maximum compression of the first material, within a second time period; attaching the lateral region to the medial region of the midsole; generating a sole assembly by attaching the midsole to the outsole; and attaching the upper to the sole assembly.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Additional aspects, features, and/or advantages of examples will be set forth in part in the description which follows and, in part, will be apparent from the description, or may be learned by practice of the disclosure.

BRIEF DESCRIPTION OF THE DRAWINGS

Non-limiting and non-exhaustive examples are described with reference to the following figures.

DETAILED DESCRIPTION

As briefly discussed above, golf footwear suspension may have at least two different functional requirements, which may include: (1) providing hours of standing comfort and miles of walking comfort and support; and (2) repeatedly supporting both feet of a golfer throughout various aspects of a golf swing. The functional requirement of walking may entail providing a neutral-angled support platform, which may support a natural degree of foot pronation that may align the golfer's ankles, lower legs, knees, and upper legs. In contrast, the functional requirement of swinging a golf club may benefit from a geometrically angled support platform that provides an everted support platform for the golfer's foot. As can be appreciated, a fixed eversion support angle may force an unnatural degree of foot pronation during walking, which, can lead to potentially deleterious knee and ankle movements that may be chronically repeated with each stop on a golf course. Similarly, a fixed neutral angle fails to provide the benefits of the everted support platform during a golf swing.

To help alleviate the above problems, among other things, the examples of the present disclosure describe a golf shoe including a regionally time-dependent midsole including a lateral region constructed of a first material and a medial region constructed of a second material. The lateral region and the medial region provide a neutral support platform when a wearer is walking, and further provides an everted supported platform when the wearer is taking a stance, such as when swinging a golf club. Examples are described below with reference to FIGS. 1A-8.

Figure 1A:
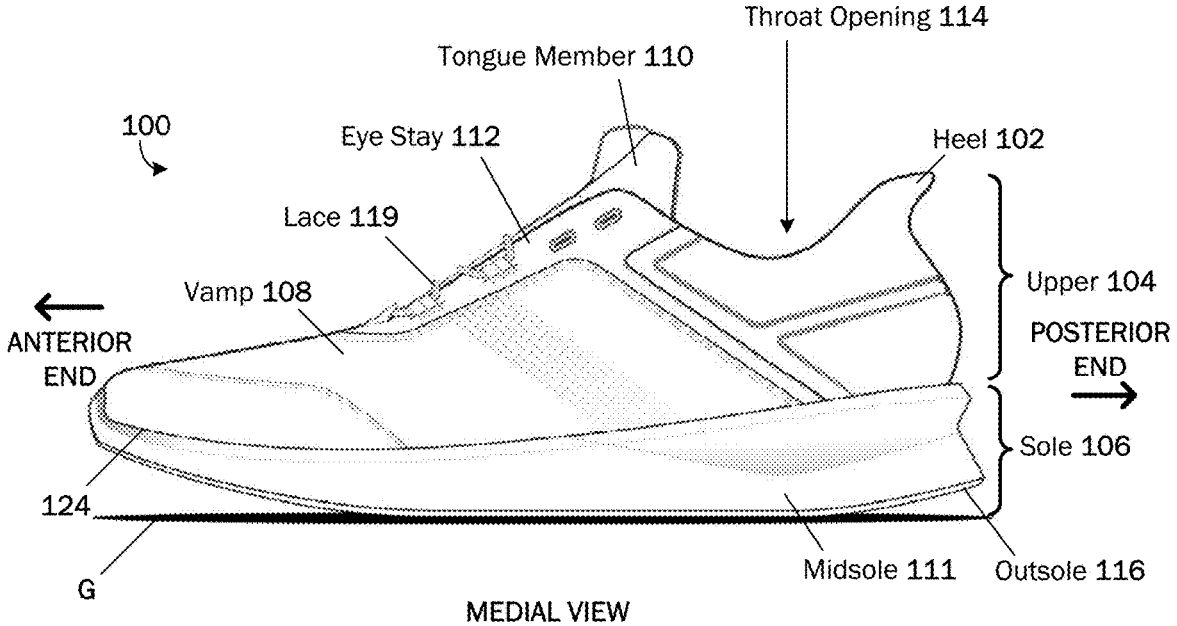
FIG. 1A depicts a medial side view of a golf shoe in which a regionally time-dependent midsole may be implemented according to an example.
Figure 1B:
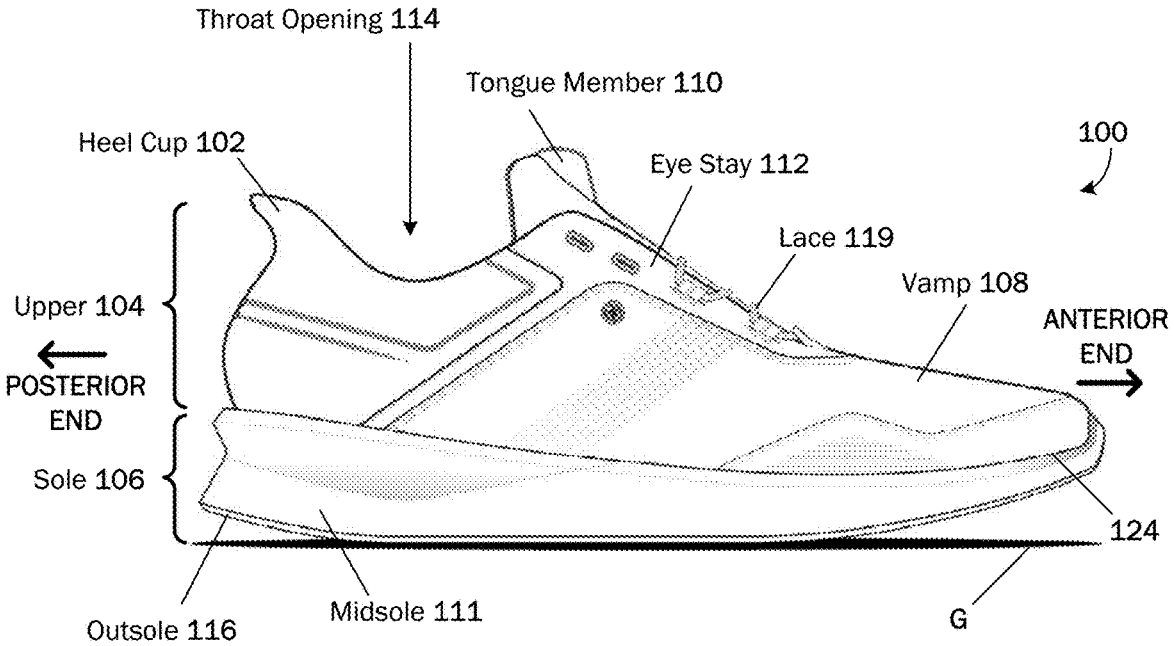
FIG. 1B depicts a lateral side view of the golf shoe of FIG. 1A according to an example.
Figure 1C:
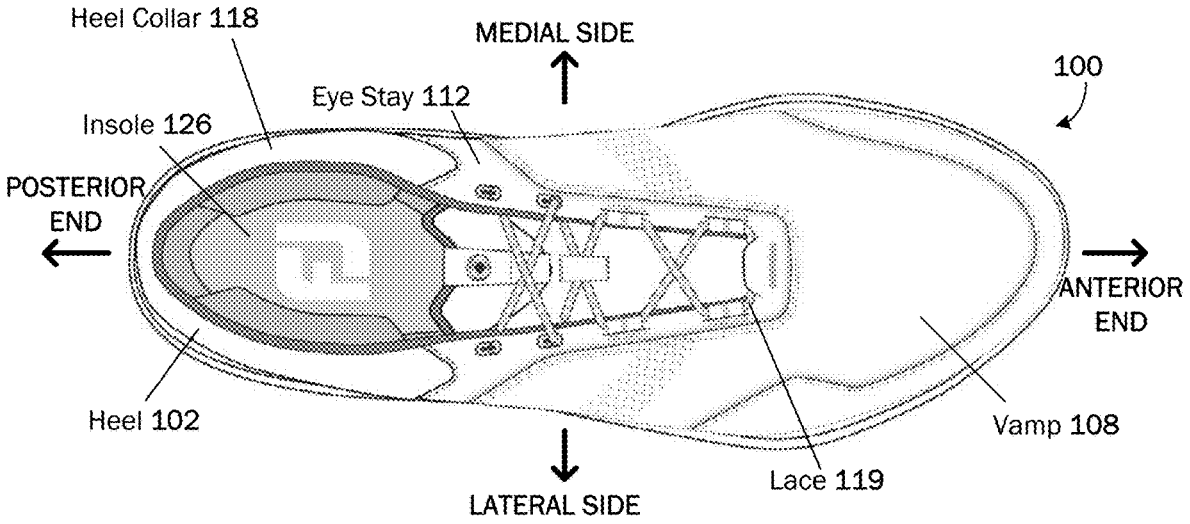
FIG. 1C depicts a dorsal (top) view of the golf shoe of FIG. 1A according to an example.
Figure 1D:
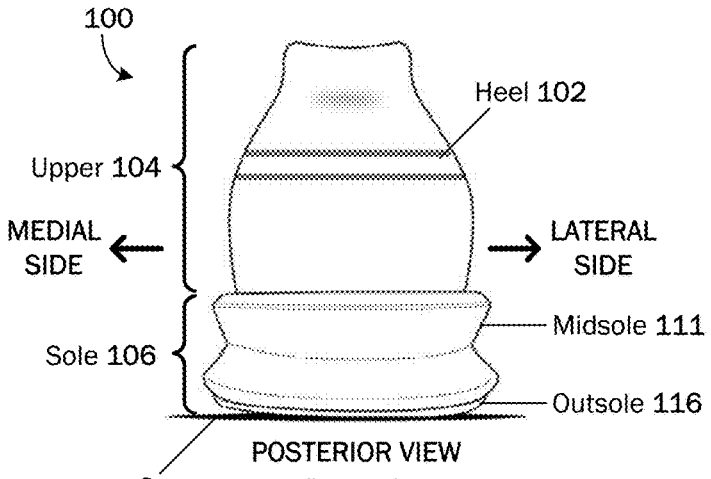
FIG. 1D depicts a posterior view of the golf shoe of FIG. 1A according to an example.

FIGS. 1A-1D depict various views of an example golf shoe 100, sometimes referred to herein generally as a shoe, in which aspects of a regionally time-dependent midsole are implemented. For example, FIG. 1A is a medial (e.g., inner) side view of the shoe 100, FIG. 1B is a lateral (e.g., outer) side view of the of the shoe 100, FIG. 1C is a dorsal (e.g., top) view of the shoe 100, and FIG. 1D is a posterior (e.g., back) view of the shoe 100. The shoe 100 may generally include a shoe upper 104 and a sole assembly 106. The sole assembly 106 may include a midsole 111 and outsole 116. The midsole 111 may be positioned above the outsole 116, such that the midsole 111 may be between the wearer's foot and the outsole 116. A bottom or outer surface of the outsole 116 is configured to engage the ground surface G on which the wearer is standing, walking, or performing a golfing action. A top or inner surface of the outsole 116 may be configured to engage a bottom surface of the midsole 111.

In general, the anatomy of the foot (generally depicted in FIG. 3A) can be divided into three bony regions. A rearfoot region generally includes the ankle (talus) and heel (calcaneus) bones. A midfoot region includes the cuboid, cuneiform, and navicular bones that form the longitudinal arch of the foot. The forefoot region includes the metatarsal bones and the toes (phalanges bones). The shoe 100, and accordingly, the upper 104, midsole 111, and outsole 116, may generally include a rearfoot area corresponding to the rearfoot and that may include a heel area, a midfoot area that corresponds to the midfoot region, and a forefoot area corresponding to the forefoot region and which may include a toe area. It is understood that the rearfoot area, midfoot area, and forefoot area are intended to represent general areas of footwear and not demarcate precise areas. As described herein, the rearfoot area (and heel area) is considered to be a posterior end of the shoe 100, and, conversely, the forefoot area, including the toe area, is considered to be an anterior end of the shoe.

As shown in FIGS. 1C and 1D, in addition to having a rearfoot area, midfoot area, and forefoot area, the shoe 100, and accordingly, the upper 104, midsole 111, and outsole 116, may also have a medial side and a lateral side that are opposite to one another. The medial side may generally correspond with an inside area of the wearer's foot and a surface that faces toward the wearer's other foot. The lateral side may generally correspond with an outside area of the wearer's foot and a surface that faces away from the wearer's other foot. The lateral side and the medial side may extend through each of the rearfoot area, the midfoot area, and the forefoot area and correspond with opposite sides of the shoe 100 (e.g., and upper 104, midsole 111, and outsole 116). The medial side and a lateral side may extend around the periphery or perimeter of the shoe 100. For example, the anterior end and posterior end may apply to the shoe 100 in general, and an anterior end and posterior end may apply to each of the upper 104, midsole 111, and outsole 116 and associated areas in reference or relation to orientation toward the front or back of the shoe 100.

The upper 104 may have a traditional shape and may be made from a combination of standard upper materials such as, for example, natural leather, synthetic leather, knits, non-woven materials, natural fabrics, and synthetic fabrics. For example, breathable mesh and synthetic textile fabrics made from nylons, polyesters, polyolefins, polyurethanes, rubbers, foams, and combinations thereof can be used. The material used to construct the upper 104 may be selected based on desired properties such as breathability, durability, flexibility, comfort, and water resistance. The upper material is stitched or bonded together to form an upper structure using traditional or non-traditional manufacturing methods.

The upper 104 may include a vamp 108, for covering the forepart of the foot, and a heel area 102 for covering and/or supporting the rear portions of a wearer's foot (e.g., the area surrounding and below the Achilles tendon, the posterior of the heel, and the talus and calcaneus bones). In some examples, the vamp 108 may cover at least a portion of a tongue member 110. In other examples, and as shown in FIGS. 1A-1D, the forepart region of the upper 104 may further include an eye stay 112 that may be attached to the vamp 108 and that may cover at least a portion of the tongue member 110.

The upper 104 may include an opening 114 for inserting a wearer's foot. In some examples, the upper 104 may further include a soft, molded foam heel collar 118 (FIG. 1C) extending around at least a portion of the opening 114 for providing enhanced comfort and fit. A variety of tightening system can be used for tightening the shoe 100 around the contour of the foot. For example, laces 119 of various types of materials (e.g., natural or synthetic fibers, metal cable) may be included in the tightening system. In one example, the shoe 100 may include a metal cable (lace)-tightening assembly that may comprise a dial, spool, and housing and locking mechanism for locking the cable in place.

It should be understood that the above-described upper 104 shown in FIGS. 1A-1D represents only one example of an upper design that can be used in the shoe 100 construction of this disclosure and other upper designs can be used without departing from the spirit and scope of this disclosure.

As stated above, the sole assembly 106 may comprise a midsole 111 and an outsole 116. The midsole 111 may be relatively lightweight and provides cushioning to the shoe 100. According to examples of the present disclosure, the midsole 111 is a regionally time-dependent midsole 111 operative to provide a neutral support angle ($a_n$) when a relatively brief compression load is placed on the midsole (e.g., when a wearer is taking a step while walking) and to further provide an everted support angle when the compression load is placed on the midsole for a longer period of time (e.g., when the wearer is swinging a golf club). For example, and as will be described in further detail below, the midsole 111 may be constructed using two different foamed materials. The regionally time-dependent midsole 111 may include a first region located on the lateral side of the midsole 111 (shown in FIG. 3A and herein referred to as the lateral region 122) constructed of a first material and a second region located on the medial side of the midsole 111 (herein referred to as the medial region 133) constructed of a second material.

The first foamed material, for example, may be a firm, relatively to highly elastic foam, such as a firm foamed ethylene vinyl acetate copolymer (EVA) composition, that may operate to reach maximum compression very quickly (e.g., nearly instantaneously, less than 1 second(s)) when under load. The second foamed material, for example, may be a highly viscous foam, similar to some types of memory foam, which may operate to reach maximum compression at a slower rate than the first foamed material. The disparate compression properties of the lateral region 122 and the medial region 133 may provide a midsole 111 that strategically provides neutral alignment during walking and further everts the wearer's feet at ball address to also provide neutral alignment when swinging a golf club. Accordingly, the shoe 100 may be optimized for providing hours of standing comfort and miles of walking comfort and support, while also supporting the wearer's feet throughout a golf swing.

In some examples, the midsole 111 may be joined to the top surface (not shown) of the outsole 116 by stitching, adhesives, or other suitable fastening means using standard or non-standard techniques known in the art. The outsole 116 may be designed to provide support and traction for the shoe. In some examples, a bottom surface of the outsole 116 may include a plurality of traction members (e.g., spikes, soft spikes, or other removable or permanent features) to help provide traction between the shoe 100 and the different surfaces of a golf course or other ground surfaces (G). The traction members can be made of any suitable material such as rubbers, plastics, and combinations thereof. Thermoplastics such as nylons, polyesters, polyolefins, and polyurethanes can be used. Various structures and geometries of traction members and outsoles 116 may be included and are within the scope of the present disclosure.

Figures 2A, 2B, 2C:
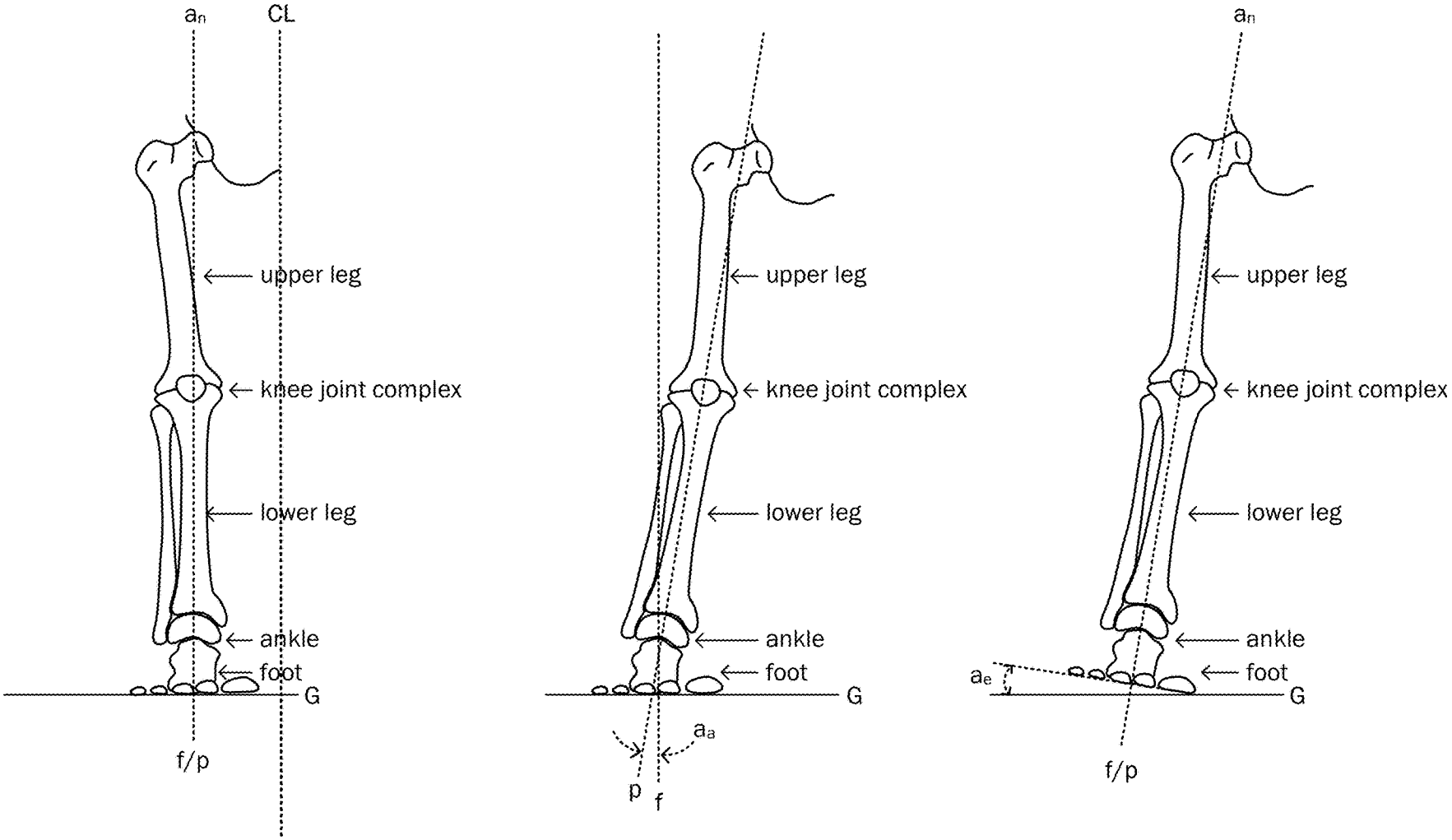
FIG. 2A depicts a neutral angle ($a_n$) of alignment of a person's lower leg relative to the person's foot flat on a ground surface when walking, according to an example.
FIG. 2B depicts an angle of alignment ($a_a$) of the person's lower leg relative to the person's foot flat on a ground surface when in a stance, such as when swinging a club, according to an example.
FIG. 2C depicts an angle of eversion that provides a neutral angle of alignment ($a_n$) of the person's lower leg relative to the person's foot placed on an everted support angle ($a_e$) relative to the ground surface when in a stance according to an example.

With reference now to FIGS. 2A-2C, a person's leg and foot are depicted in relation to a ground surface (G). FIG. 2A depicts an example alignment of the person's leg and foot when the foot is aligned near the person's body's vertical centerline (CL), such as when walking. According to an example, during walking, the foot cycles between an unloaded/flight phase (e.g., foot off the ground surface (G)) and a loaded/support phase (e.g., foot in contact with the ground surface (G)) with every other step. For example, throughout the unloaded period, the person's foot may swing/pendulum close to the surface-projected body center of mass. Then, at commencement of the loaded period, the foot may contact the ground surface (G) close to the person's body vertical centerline (CL).

According to an aspect and as will be described in further detail below, the shoe 100 may be configured to align the wearer's foot, ankle, and knee joint complex throughout a walking gait cycle and while swinging a golf club. With such a minimal vertical angle between the plane (p) of the lower leg, knee joint, and upper leg of the wearer's support leg and the wearer's body center (centerline (CL)) throughout the walking gait cycle, the shoe 100 may be ideally configured to function with little or no geometrical or mechanical differences between the lateral region 122 and the medial region 133 of the midsole 111 throughout the walking gait cycle to maintain a neutral angle of alignment ($a_n$) of the plane (p) of the person's support leg relative to the vertical centerline of the person's foot (f) flat on the ground surface (G). For example, a neutral angle of alignment ($a_n$) may reduce unwanted kinematics while walking, such as excessive initial pronation velocity and maximum pronation ankle.

Aligning the wearer's foot, ankle, and knee joint complex while swinging a golf club has different requirements than alignment while walking. For example, and with reference now to FIG. 2B, during a golf swing, the person's feet may be typically spread out shoulder width or wider at ball address. As shown in FIG. 2B, when the person is in a wider-legged stance, such as when swinging a club, and when the person's foot is flat on the ground surface (G), the vertical centerline of the person's foot (f) may be placed in a slightly inverted position (angle of alignment $a_a$) with respect to the plane (p) of the lower leg, knee joint, and upper leg. As can be appreciated, this slight misalignment (angle of alignment $a_a$), although can be accommodated by ankle joint mobility, can make weight transfer and angular momentum generating kinematics less than optimal and can substantially affect a golfer's performance.

According to an aspect of the present disclosure, a neutral angle of alignment ($a_n$) of the person's foot (f) with respect to the plane (p) of the lower leg, knee joint, and upper leg during a swing stance (e.g., when the person is in a wider-legged stance) may be desirable to provide support for maximizing swinging control and power. In examples, and as depicted in FIG. 2C, this neutral angle of alignment ($a_n$) may be achieved by creating an eversion angle ($a_e$) between the person's foot and the ground surface (G) when swinging a golf club. As will be described in detail below with respect to FIGS. 3A-8, the relatively elastic lateral region 122 of the regionally time-dependent midsole 111 and the highly viscous medial region 133 of the midsole 111 may operate as a time-dependent biasing valgus wedge that creates the eversion angle ($a_e$) between the person's foot and the ground surface (G).

Figure 3A:
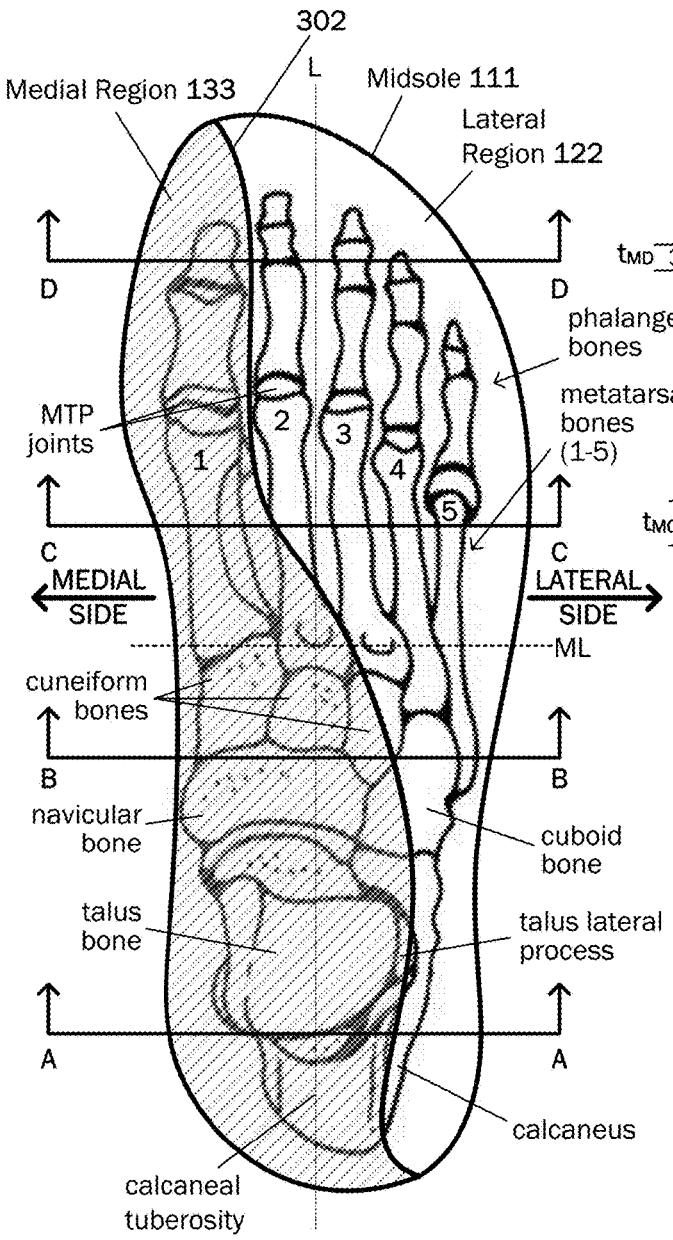
FIG. 3A depicts a dorsal view of a regionally time-dependent midsole with reference to anatomy of a wearer's foot according to an example.
Figure 3B:
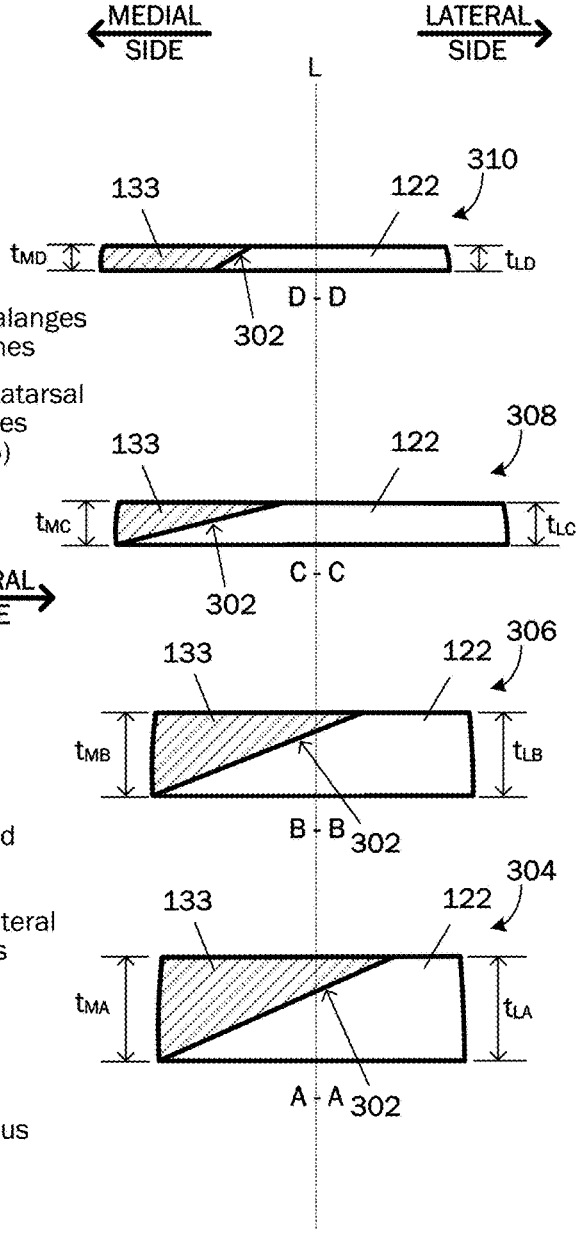
FIG. 3B depicts various cross-sectional views of the regionally time-dependent midsole of FIG. 3A when unloaded according to an example.

FIG. 3A, shows a dorsal view of a regionally time-dependent midsole 111 with reference to anatomy of a wearer's foot according to an example and FIG. 3B shows various cross-sectional views 304, 306, 308, 310 of the midsole 111 of FIG. 3A. As depicted, the midsole 111 may include the lateral region 122 longitudinally traversing the length of the lateral side of the sole 106 and medial region 133 longitudinally traversing the length of the medial side of the sole 106. According to an example, the time-dependent biasing valgus wedge may be provided by different viscoelastic instantaneous elastic and anelastic creep properties of the lateral region 122 and the medial region 133 of the midsole 111. For example, the properties of the first and second materials of the lateral region 122 and medial region 133 may provide a neutral support angle ($a_n$) when a relatively brief compression load (e.g., up to 0.3 s, up to 0.6 s, or up to 1 s) is placed on the midsole (e.g., when the wearer is taking a step while walking) and an everted support angle (eversion angle ($a_e$)) when the compression load is placed on the midsole for a longer period of time (e.g., 2.5-6 s), such as when the wearer is swinging a golf club.

The lateral region 122 and the medial region 133 of the midsole 111 may be joined along a knit line 302. As depicted in FIG. 3B, the knit line 302 may be vertically blended to an inferior surface (e.g., top surface of the outsole 116) to provide a smooth transition between the lateral region 122 and the medial region 133. For example, the knit line 302 may be formed between a mediolaterally angled joining surface of the lateral region 122 and an opposing mediolaterally angled joining surface of the medial region 133. According to an example, orientation of the angular joining surfaces between the first and second materials of the lateral region 122 and medial region 133 enable the first and second materials to be engineered to provide specific time-dependent foot eversion (e.g., a time-biasing eversion angle ($a_e$)). In one example implementation and as depicted in FIG. 3A, the knit line 302 may longitudinally traverse the length of the sole 106 and be strategically positioned to align between the wearer's first (big) toe and second toe, the first and second metatarsophalangeal (MTP) joints, and the talus lateral process and the lateral edge of the calcaneal tuberosity.

The cross-sectional views 304, 306, 308, 310 of the midsole 111 shown in FIG. 3B depict variable unstressed thicknesses/heights of the lateral region 122 and medial region 133 along the length (L) of the midsole 111. As shown, the unstressed thickness of the lateral 122 and medial 133 regions of the midsole 111 along cutting plane A-A (e.g., located in the heel area toward the posterior end of the midsole 111) may be a first lateral and medial thickness ($t_{LA}$, $t_{MA}$), respectively; the unstressed thicknesses of the lateral 122 and medial 133 regions of the midsole 111 along cutting plane B-B (e.g., located between the midline (ML) of the midsole 111 and cutting plane A-A) may be a second lateral and medial thickness ($t_{LB}$, $t_{MB}$), respectively, where the second lateral and medial thicknesses ($t_{LB}$, $t_{MB}$) may be less than the first lateral and medial thicknesses ($t_{LA}$, $t_{MA}$); the unstressed thicknesses of the lateral 122 and medial 133 regions of the midsole 111 along cutting plane C-C (e.g., located on the anterior side of the midsole 111 approximately a same distance from the midline (ML) as the distance between the midline (ML) and cutting plane B-B) may be a third lateral and medial thickness ($t_{LC}$, $t_{MC}$), respectively, where the third lateral and medial thicknesses ($t_{LC}$, $t_{MC}$) may be less than the second lateral and medial thicknesses ($t_{LB}$, $t_{MB}$); and the unstressed thicknesses of the lateral 122 and medial 133 regions of the midsole 111 along cutting plane D-D (e.g., located in the toe area toward the anterior end of the midsole 111) may be a fourth lateral and medial thickness ($t_{LD}$, $t_{MD}$), respectively, where the fourth lateral and medial thicknesses ($t_{LD}$, $t_{MD}$) may be less than the third lateral and medial thicknesses ($t_{LC}$, $t_{MC}$). For example: along cutting plane A-A, the medial region 133 forms 60%-80% or 70%-100% of the width of the midsole 111; along cutting plane B-B, the medial region 133 forms 60%-80% of the width of the midsole 111; along cutting plane C-C, the medial region 133 forms 25%-45% of the width of the midsole 111; and along cutting plane D-D, the medial region 133 forms 25%-40% of the width of the midsole 111. In one example implementation, for an average adult male shoe size, the first lateral and medial thicknesses ($t_{LA}$, $t_{MA}$) may range from approximately 18 mm-26 mm, the second lateral and medial thicknesses ($t_{LB}$, $t_{MB}$) may range from approximately 14 mm-22 mm, the third lateral and medial thicknesses ($t_{LC}$, $t_{MC}$) may range from approximately 8 mm-16 mm, and the fourth lateral and medial thicknesses ($t_{LD}$, $t_{MD}$) may range from approximately 6 mm-12 mm. As should be appreciated, other thickness profiles are possible and are within the scope of the present disclosure.

Figure 4:
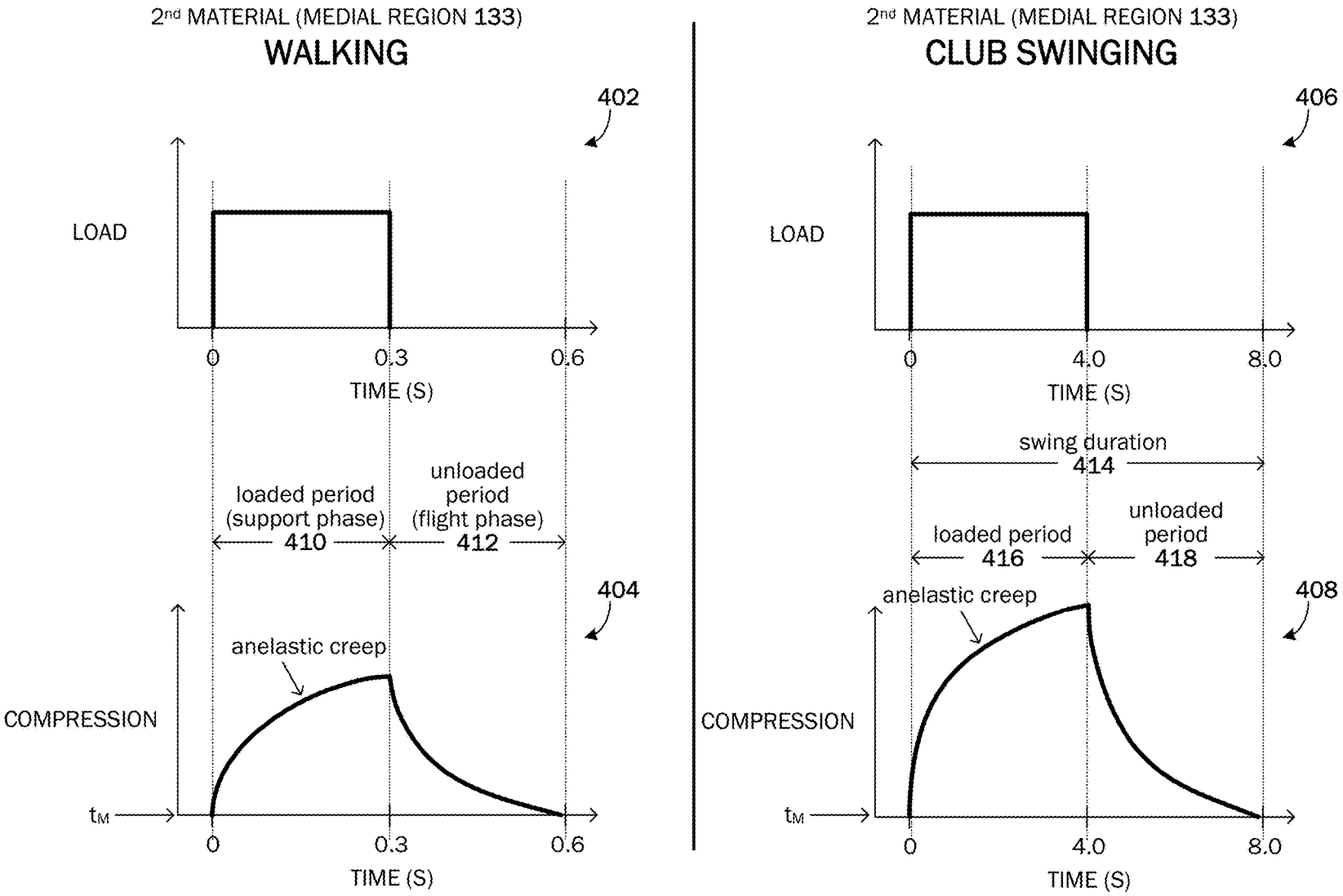
FIG. 4 depicts anelastic creep properties of viscoelastic (medial) region of the regionally time-dependent midsole of FIG. 3A when loaded for a first time duration (e.g., a foot strike of a walking gait) versus when loaded for a second (longer) time duration (e.g., when swinging a golf club) according to an example.

According to an aspect, during walking, the medial region 133 may operate to compress similarly to the lateral region 122 of the regionally time-dependent midsole 111, and during swinging a golf club (e.g., while the golfer is in place taking a stance), the medial region 133 may operate to further compress based on anelastic creep properties of the second foam material. With reference now to FIG. 4, example anelastic creep properties of the viscoelastic medial region 133 of the regionally time-dependent midsole 111 are depicted. For example, a first load profile 402 and a first compression profile 404 are depicted for a compression duration representative of a walking gait cycle (walking cycle) of a golfer's foot. Additionally, a second load profile 406 and a second compression profile 408 are depicted for a compression duration representative of the golfer's golf swing.

As mentioned above, during walking, the foot cycles between an unloaded period 412 (e.g., flight phase or foot off the ground surface (G)) and a loaded period 410 (e.g., support phase or foot in contact with the ground surface (G)) with every other step. For example, the walking cycle may include various stages that each foot may undergo. A first stage of the walking cycle and of the loaded period 410, which may be referred to as a heel strike phase, may begin when the heel first touches the ground surface (G), and may last until the whole foot is on the ground surface (G). For example, the golfer may slightly dorsiflex the foot, and the heel may strike the ground surface (G) first as the golfer starts their walking gait.

A second stage of the walking cycle, which may be referred to as a foot flex stage, may begin when the golfer's whole foot is on the ground as the golfer transfers their weight from the heel to the toes. For example, the golfer's arch may be flattened and the foot may serve as a shock absorber, helping to cushion the force of the golfer's body weight as the foot presses downwardly. The end of the foot flex stage may occur when the golfer's center of gravity passes over top of the foot.

A third stage of the walking cycle, which may be referred to as a midstance stage, may begin when the golfer's center of mass is directly above the ankle joint center and the hip joint center is above the ankle joint.

A fourth stage of the walking cycle, which may be referred to as a heel-off stage, may begin when the golfer's center of gravity has passed the neutral position. The end of the heel-off stage may occur when the golfer's heel begins to leave the ground surface (G). For example, the golfer's foot may plantarflex, and the golfer's foot may function as a rigid lever to move the body forward.

A fifth and last stage of the stance phase may be referred to as a toe-off stage. The toe-off stage may begin as the golfer's toes leave the ground. For example, the foot may continue to plantarflex and push off the ground until the golfer's foot is in the air. The toe-off stage may be the last event of contact during the loaded period 410 of the walking gait cycle.

As shown in FIG. 4 and with reference to the first load profile 402, based on example timing patterns of walking kinematics, an example loaded period 410 of a walking gait is shown occur for a first example time duration of approximately 0.2 s-0.4 s. As depicted in the first compression profile 404, during this loaded period 410 (e.g., 0.3 s) of the walking gait, the second foam material of the midsole 111 may have properties that cause the medial region 133 to have minimal anelastic creep. Additionally, the properties of the second foam material may cause the medial region 133 to recover (e.g., decompress) during the unloaded period 412 (e.g., 0.2 s-0.6 s) of the walking gait to its unstressed/unloaded thickness ($t_{UM}$).

Example anelastic creep properties of the viscoelastic medial region 133 of the regionally time-dependent midsole 111 for a compression duration representative of the golfer's golf swing are further depicted in FIG. 4. According to an example implementation, an example golf swing duration 414 may range from approximately 6.0 s-10.0 s. The golf swing duration 414, in one example, may include the time the golfer sets their lead foot, steps over the ball, and swings to completion of the golf swing, which is represented in the second load 406 profile and the second compression profile 408 as 8.0 s. Based on example time patterns, a loaded period 416 (e.g., when the golfer's foot is weighted and a compression load is placed on the midsole 111) may be approximately half the golf swing duration 414 (e.g., 2.5 s-6.0 s). The loaded period 416 is represented in the second load profile 406 and the second compression profile 408 as 4.0 s. Additionally, an example unloaded period 418 of the golf swing is represented in the second load profile 406 and the second compression profile 408 as 4.0 s. As can be appreciated, other golf swing durations 414, other loaded periods 416, and other unloaded periods 418 of golf swings are possible and are within the scope of the present disclosure. Generally, and as depicted in the first 402 and second 406 load profiles, a compression load is placed on the midsole 111 for a longer period of time during a golf swing (e.g., 4.0 s) than during a walking step (e.g., 0.3 s). Accordingly, this additional amount of time may allow time for further anelastic creep (shown in the second compression profile 408) of the medial region 133 of the midsole 111 to further compress, and thereby placing the golfer's foot in an everted position (e.g., eversion angle ($a_e$)) with respect to the ground surface (G). Moreover, as was shown in FIG. 2C, this eversion angle ($a_e$) may align the golfer's foot, ankle joint, and leg complex during the golf swing, which can optimize weight transfer and angular momentum generating kinematics and increase club swinging control and power.

Figure 5:
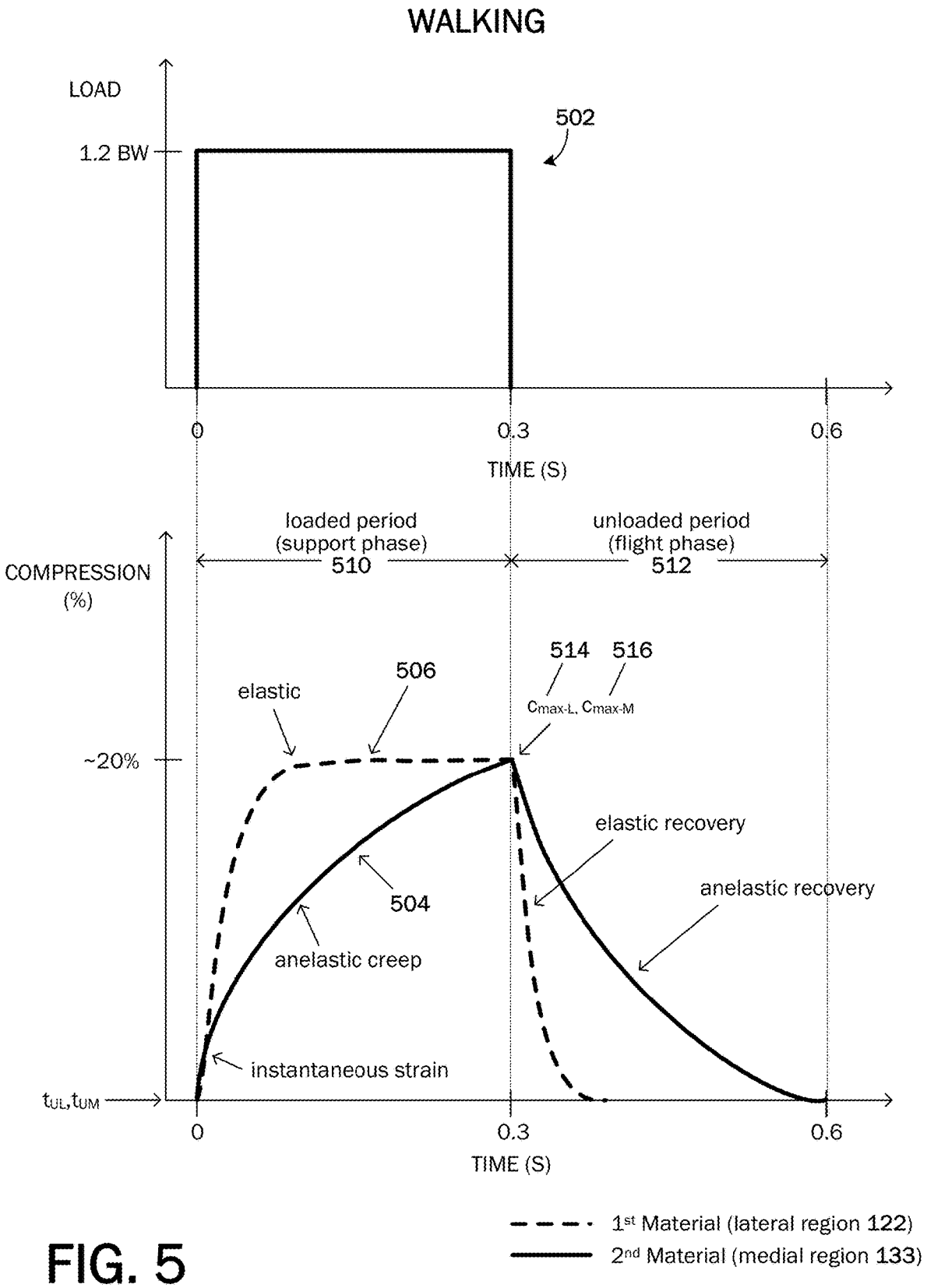
FIG. 5 depicts a compression profile of the viscoelastic (medial) region and a compression profile of an elastic (lateral) region of the regionally time-dependent midsole of FIG. 3A for providing a neutral support angle when loaded for the first time duration according to an example.

With reference now to FIG. 5, an example load profile 502 of a golfer's foot including a compression loaded period 510 (e.g., support phase) of a walking gait cycle (walking cycle) is depicted. The example load (sometimes referred to herein as a first load) included in the example load profile 502 is represented as 1.2× the golfer's body weight (BW), and is depicted as being applied for 0.3 s (i.e., support phase 510). For instance, the peak of a ground reaction force sine wave representative of a step from heel strike to toe-off may be approximately 1.2 BW. As should be appreciated, other load profiles 502 including alternative load amounts and/or support phase 510 durations may be utilized for configurating the midsole 111 and are within the scope of the present disclosure. Additionally, an example compression profile 504 of the viscoelastic (medial) region 133 (represented by a solid line) and an example compression profile 506 of the elastic (lateral) region 122 (represented by a dashed line) of the regionally time-dependent midsole 111 are depicted. For instance, the example compression profiles 504, 506 depicted in FIG. 5 may provide a neutral support angle ($a_n$) when loaded for the example loaded phase 510 duration (e.g., 0.3 s), which is representative of a step of a walking cycle and sometimes referred to herein as a first loaded duration).

According to an example, the compression profile 504 of the medial region 133 may be the same or similar to the example first compression profile 404 depicted in FIG. 4. For instance, the compression profile 504 during the loaded period 510 (e.g., 0.3 s) of the walking gait depicts the second foam material of the medial region 133 of the midsole 111 having minimal anelastic creep properties that cause the medial region 133 to reach maximum compression ($c_{max\text{-}M}$) 516 at approximately the end of the loaded period 510 (e.g., In an example and as depicted in FIG. 5, the minimal anelastic creep properties of the second foam material of the medial region 133 may cause the medial region 133 to reach maximum compression ($c_{max\text{-}M}$) 516 more slowly than the lateral region 122. According to examples, during the loaded period 510 of a walking gait cycle, the midsole 111 may be relatively firm or stiff, where the maximum compression ($c_{max\text{-}M}$) 516 of the medial region 133 may range from approximately 15%-30% compression of its unstressed (unloaded) thickness ($t_{UM}$). In one example implementation, the maximum compression ($c_{max\text{-}M}$) 516 of the medial region 133 may be approximately 20% compression of its unloaded thickness ($t_{UM}$) (e.g., the thickness of the medial region 133 at maximum compression ($c_{max\text{-}M}$) is 80% of the unloaded thickness ($t_{UM}$)).

Additionally, the compression profile 506 of the lateral region 122 during the loaded period 510 (e.g., 0.3 s) of the walking gait depicts the first foam material of the midsole 111 having elastic properties. For example, the elastic properties of the first foam material may cause the lateral region 122 to reach a maximum compression ($c_{max\text{-}L}$) 514 at the end of the loaded period 510 of the walking gait (e.g., 0.3 s) that is the same or approximately similar to the maximum compression ($c_{max\text{-}M}$) 516 of the medial region 133 (e.g., 20% compression of the unloaded thickness ($t_{UM}$) of the midsole 111 at approximately 0.3 s). Accordingly, during the loaded period 510 of a walking gait cycle, the midsole 111 may be relatively firm or stiff (e.g., 15%-30% compression of its unstressed (unloaded) thickness ($t_{UM}$)), and may provide a neutral support angle ($a_n$) when loaded with a first load for the first loaded duration.

As the walking gait continues, the golfer's heel may begin to lift and unload. Based on example time patterns, during an unloaded period 512, the golfer's foot may leave the ground surface (G), and thus, the midsole 111 may be compressively unloaded between approximately 0.3 s-0.6 s, as depicted in the load profile 502 in FIG. 5. According to an aspect, the elastic properties of the first material may correlate with elastic recovery properties that cause the lateral region 122 to recover or equilibrate to its unloaded thickness ($t_L$) within the unloaded period 512. In an example, expansion of the lateral region 122 to its unloaded thickness ($t_L$) may be nearly immediate. As shown in the compression profiles 504, 506 in FIG. 5, the anelastic creep properties of the second material may correlate with anelastic recovery properties that cause the medial region 133 to recover or equilibrate to its unloaded thickness ($t_{UM}$) approximately within the flight phase 512, but at a rate slower than the lateral region 122. For instance, anelastic recovery of the medial region 133 may include a larger portion of the unloaded period 512 of the walking gait than the elastic recovery time of the lateral region 122. In some examples, the regionally time-dependent midsole 111 is constructed with various ranges of compression properties. For instance, the shoe 100 can be customized to have a less compressive or more compressive midsole 111, and the wearer may be enabled to select a shoe 100 to support the specific needs or desires of the wearer.

Figure 6:
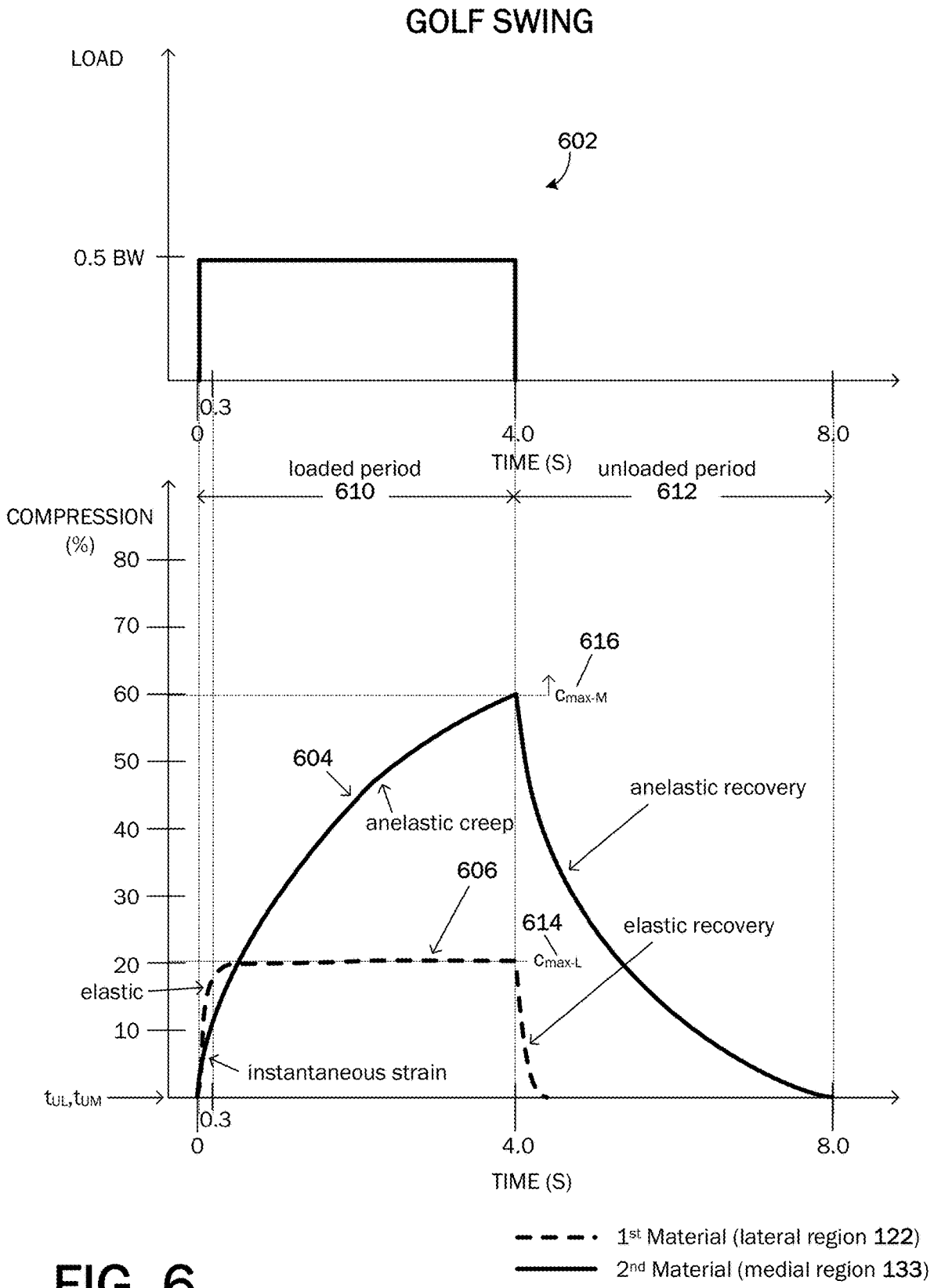
FIG. 6 depicts a compression profile of the viscoelastic (medial) region and a compression profile of the elastic (lateral) region of the regionally time-dependent midsole of FIG. 3A for providing an everted support angle when loaded for the second time duration according to an example.

With reference now to FIG. 6, an example load profile 602 including a compression loaded period 610 (sometimes referred to herein as a second loaded period) of a golfer's foot during a golf swing cycle is depicted. The example load included in the example load profile 602 (sometimes referred to herein as a second load) is represented as 0.5× the golfer's body weight (BW) (e.g., the golfer's BW distributed between both feet), and is depicted as being applied for 4.0 s (i.e., loaded period 610). As should be appreciated, other load profiles 602 including alternative load amounts and/or loaded period 610 durations may be utilized for configurating the midsole 111 and are within the scope of the present disclosure. Additionally, an example compression profile 604 of the viscoelastic (medial) region 133 (represented by a solid line) and an example compression profile 606 of the elastic (lateral) region 122 (represented by a dashed line) of the regionally time-dependent midsole 111 are depicted. For instance, the example compression profiles 604, 606 depicted in FIG. 6 may provide an everted support angle ($a_e$) with reference to the ground surface (G) when loaded with the second load for the for the example loaded period 610 duration (e.g., 4.0 s), which is representative of a support or stance phase of a golf swing cycle.

According to an example, the compression profile 606 of the lateral region 122 during the loaded period 610 (e.g., 4.0 s) of the golf swing cycle depicts the first foam material of the lateral region 122 of the midsole 111 having elastic properties. For example, the elastic properties of the first foam material may cause the lateral region 122 to reach its maximum compression ($c_{max\text{-}L}$) 614 quickly. In an example implementation and as depicted in FIG. 6, the maximum compression ($c_{max\text{-}L}$) 614 of the lateral region 122 may be approximately 20% compression of its unstressed (unloaded) thickness ($t_{UL}$), which the lateral region 122 may reach within a range of approximately 0.2 s-0.6 s (e.g., 0.3 s). According to an example, the lateral region 122 of the midsole 111 may continue to be relatively firm or stiff (e.g., 15%-30% compression of its unstressed (unloaded) thickness ($t_{UL}$)) throughout the second loaded period 610.

Additionally, the compression profile 604 of the medial region 133 may be the same or similar to the example second compression profile 408 depicted in FIG. 4. For instance, the compression profile 604 during the loaded period 610 (e.g., 4.0 s) of the golf swing depicts the second foam material of the midsole 111 having minimal anelastic creep properties that cause the medial region 133 to continue to compress to its maximum compression ($c_{max\text{-}M}$) 616 at approximately the end of the second loaded period 610 (e.g., 4.0 s). According to an example, the maximum compression ($c_{max\text{-}M}$) 616 of the medial region 133 may range from approximately greater than or equal to 55% (e.g., 55%-80%) compression of its unstressed (unloaded) thickness ($t_{UM}$) (e.g., the thickness of the medial region 133 may be 20%-45% of the unstressed (unloaded) thickness ($t_{UM}$)). In one example implementation, and as depicted in FIG. 6, the maximum compression ($c_{max\text{-}M}$) 616 of the medial region 133 may be approximately 60% compression of its unstressed (unloaded) thickness ($t_{UM}$) with approximately the second load and at approximately the end of the loaded period 610 (e.g., 4.0 s). That is, and as depicted in FIG. 6, the minimal anelastic creep properties of the second foam material of the medial region 133 may cause the medial region 133 to reach its maximum compression ($c_{max\text{-}M}$) 616 more slowly than the lateral region 122 reaching its maximum compression ($c_{max\text{-}L}$) 614, which may provide an everted support angle ($a_e$) with respect to the ground surface (G) when loaded for the example loaded period 610 duration (e.g., 4.0 s). The everted support angle ($a_e$), for example, may provide a stable platform and a neutral angle of alignment ($a_n$) of the golfer's lower leg relative to the golfer's foot so that the golfer can maintain their balance as they perform their swinging action.

As the golf swing cycle continues, the golfer's heel may begin to lift and unload. Based on example time patterns, during an unloaded period 612 of the golf swing, the golfer's foot may leave the ground surface (G), and thus, the midsole 111 may be compressively unloaded between approximately 4.0 s-8.0 s, as depicted in the load profile 602 in FIG. 6. According to an aspect, the elastic properties of the first material of the lateral 122 region may correlate with elastic recovery properties that cause the lateral region 122 to recover or equilibrate to its unloaded thickness ($t_{UL}$) within the unloaded period 612. In an example, expansion of the lateral region 122 to its unloaded thickness ($t_{UL}$) may be nearly immediate. As shown in the compression profile 604 of the medial region 133 in FIG. 6, the anelastic creep properties of the second material may correlate with anelastic recovery properties that cause the medial region 133 to recover or equilibrate to its unloaded thickness ($t_{UM}$) approximately within the unloaded period 612, but at a rate slower than recovery of the lateral region 122. For instance, the anelastic recovery of the medial region 133 may include a larger portion of the unloaded period 612 of the golf swing than the elastic recovery of the lateral region 122. Recovery of the lateral region 122 and the medial region 133 at approximately the end of the unloaded period 612 may enable the midsole 111 to then provide a neutral support angle ($a_n$) for the golfer's next step in a next cycle.

Figure 7A:
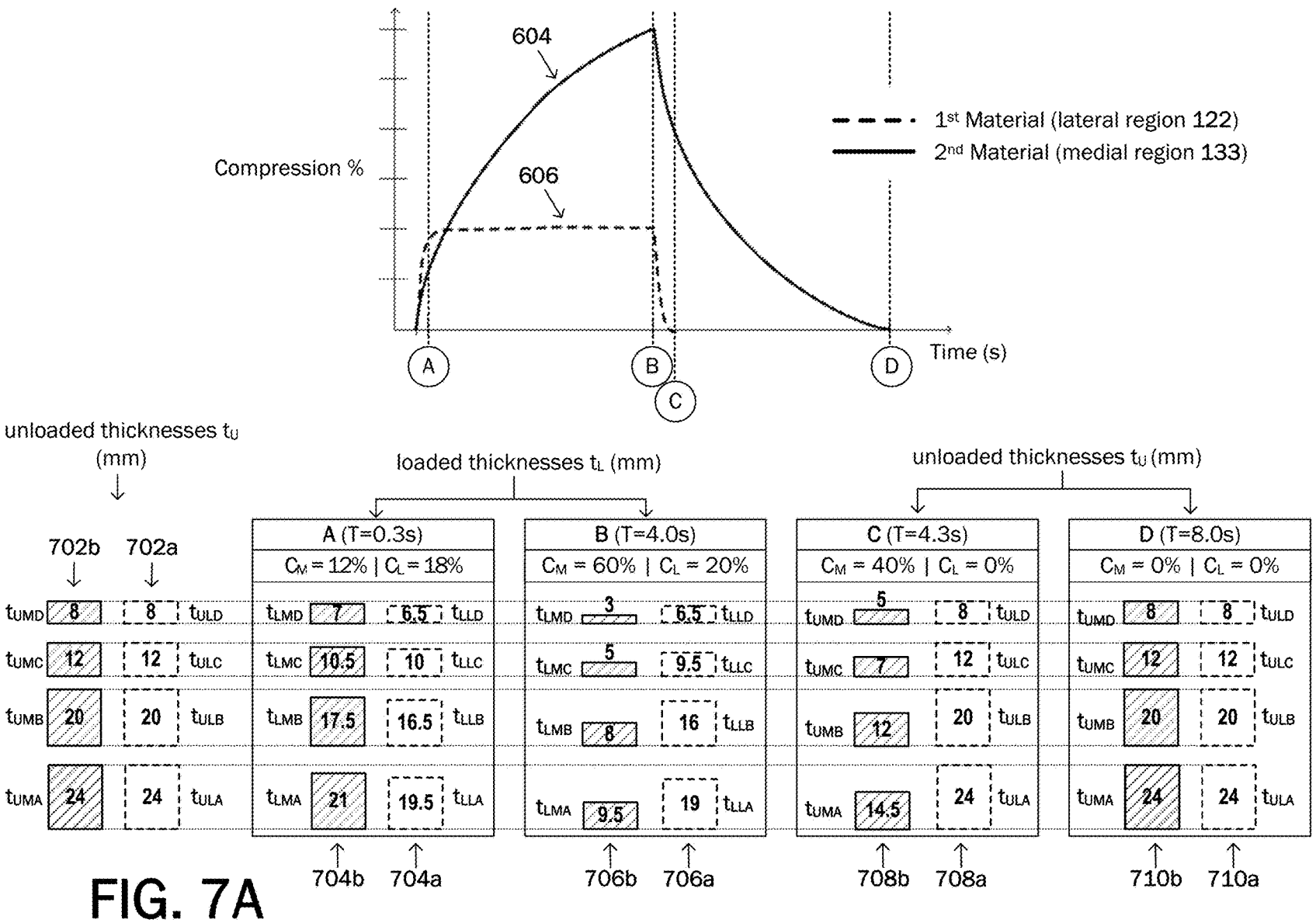
FIG. 7A shows a time series view depicting a change in compression of the viscoelastic (medial) region and the elastic (lateral) region of the regionally time-dependent midsole over time according to an example.
Figure 7B:
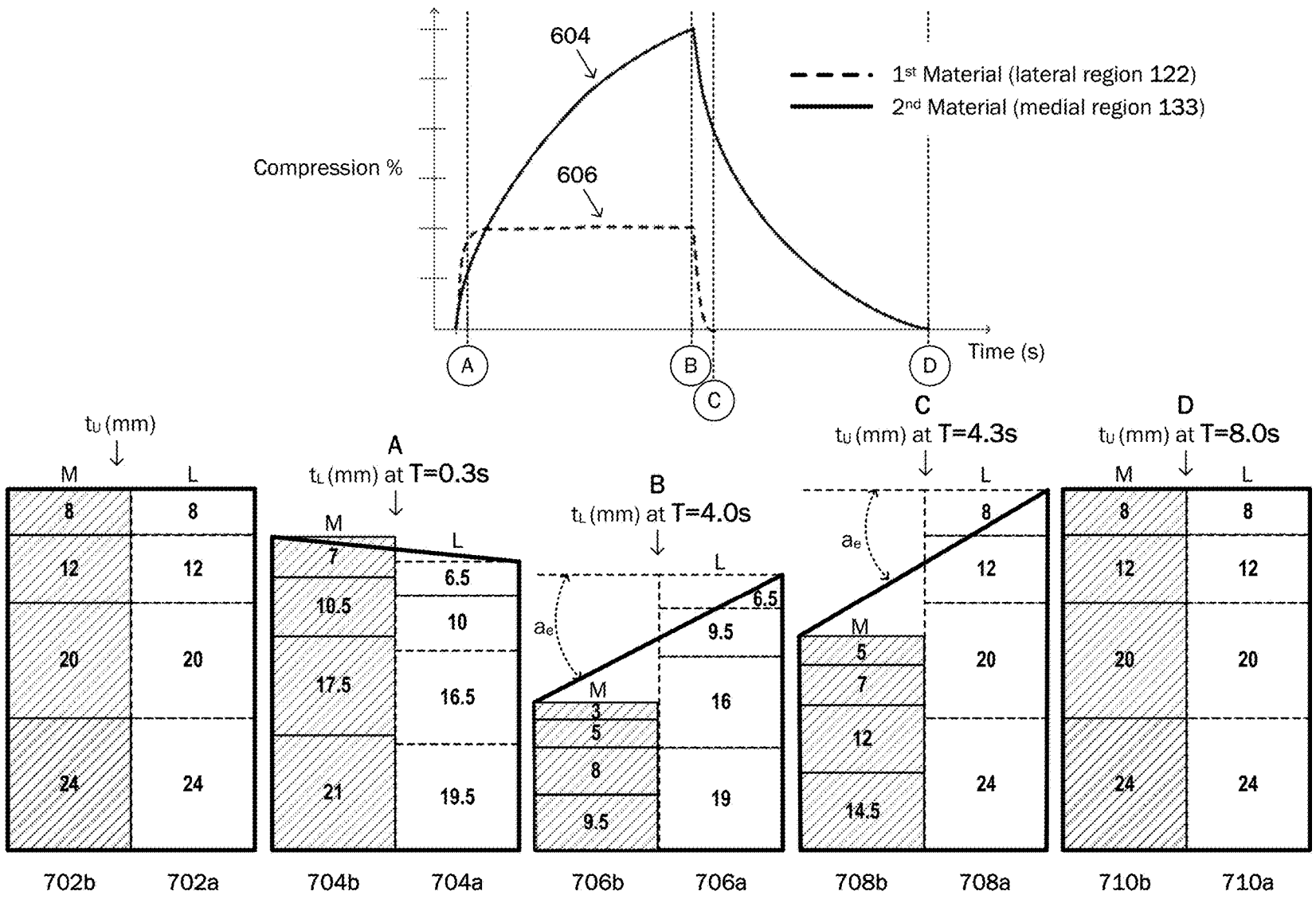
FIG. 7B shows another time series view depicting a change in compression of the viscoelastic (medial) region and the elastic (lateral) region of the regionally time-dependent midsole over time according to an example.

With reference now to FIGS. 7A and 7B, time series views showing example changes in compression of the elastic lateral region 122 and the viscoelastic medial region 133 of the regionally time-dependent midsole 111 over time during a golf swing cycle are provided. For example, the unloaded thicknesses 702*a*, 708*a*, 710*a* of the lateral region 122 and the unloaded thicknesses 702*b*, 708*b*, 710*b* of the medial region 133 include example measurements at the various cutting planes in FIGS. 2A and 2B when the midsole 111 is unloaded, and the loaded thicknesses 704*a*, 706*a* of the lateral region 122 and the loaded thicknesses 704*b*, 706*b* of the medial region 133 include example measurements at the various cutting planes when the midsole 111 is loaded with an example second load (e.g., Example unloaded lateral thicknesses 702*a*, 708*a*, 710*a* illustrating recovery of the lateral region 122 when unloaded may include a first unloaded lateral thickness ($t_{ULA}$) of 24 mm, a second lateral thickness ($t_{LB}$) of 20 mm, a third lateral thickness ($t_{LC}$) of 12 mm, and a fourth lateral and medial thickness ($t_{LD}$) of 8 mm. Example unloaded medial thicknesses 702*b*, 710*b* illustrating recovery of the medial region 133 when unloaded (e.g., at T=0 s and T=8.0 s) may include an first unloaded medial thickness ($t_{MA}$) of 24 mm, a second medial thickness ($t_{MB}$) of 20 mm, a third medial thickness ($t_{MC}$) of 12 mm, and a fourth medial thickness ($t_{MD}$) of 8 mm. Additionally, example unloaded medial thicknesses 708*b* illustrating recovery of the medial region 133 when unloaded (e.g., at T=4.3 s) may further include a first unloaded medial thickness ($t_{MA}$) of 14.5 mm, second medial thickness ($t_{MB}$) of 12 mm, a third medial thickness ($t_{MC}$) of 7 mm, and a fourth medial thickness ($t_{MD}$) of 5 mm. As can be appreciated, in other examples, other unloaded thicknesses 702, 708, 710 of the midsole 111 may be incorporated and are within the scope of the present disclosure.

As shown in FIGS. 7A and 7B, at time (T)=0, the golfer may place a load (e.g., the second load) on the midsole 111, which may cause the medial region 133 and the lateral region 122 of the midsole 111 to begin compressing. According to an example, at T=0.3 s (A), the first material of the lateral region 122 may compress 18% of its unloaded thickness ($t_{UL}$) and the second material of the medial region 133 may compress 12% of its unloaded thickness ($t_{UM}$). Thus, at roughly cutting plane A-A of the midsole 111, the first loaded thickness ($t_{LLA}$) of the lateral region 122 may be approximately 19.5 mm and the first loaded thickness ($t_{LMA}$) of the medial region 133 may be approximately 21 mm; at roughly cutting plane B-B, the first loaded thickness ($t_{LLB}$)) of the lateral region 122 may be approximately 16.5 mm and the first loaded thickness ($t_{LMB}$) of the medial region 133 may be approximately 17.5 mm; at roughly cutting plane C-C, the first loaded thickness ($t_{LLC}$) of the lateral region 122 may be approximately 10 mm and the first loaded thickness ($t_{LMC}$) of the medial region 133 may be approximately 10.5 mm; and at roughly cutting plane D-D, the first loaded thickness ($t_{LLD}$) of the lateral region 122 may be approximately 6.5 mm and the first loaded thickness ($t_{LMD}$) of the medial region 133 may be approximately 7 mm. Thus, and as shown in FIG. 7B, compression of the lateral region 122 and the medial region 133 may be equal or similar (e.g., within approximately 3.5 mm).

After T=0.3 s (A), the medial region 133 may continue compressing. For example, at approximately T=4.0 s (B), which may be related to golfer's stance of a golf swing, the first material of the lateral region 122 may compress 20% of its unloaded thickness ($t_{UL}$) and the second material of the medial region 133 may compress 60% of its unloaded thickness ($t_{UM}$). Thus, at roughly cutting plane A-A of the midsole 111, the second loaded thickness ($t_{LLA}$) of the lateral region 122 may be approximately 19 mm and the second loaded thickness ($t_{LMA}$) of the medial region 133 may be approximately 9.5 mm; at roughly cutting plane B-B, the second loaded thickness ($t_{LLB}$)) of the lateral region 122 may be approximately 16 mm and the second loaded thickness ($t_{LMB}$) of the medial region 133 may be approximately 8 mm; at roughly cutting plane C-C, the second loaded thickness ($t_{LLC}$) of the lateral region 122 may be approximately 9.5 mm and the second loaded thickness ($t_{LMC}$) of the medial region 133 may be approximately 5 mm; and at roughly cutting plane D-D, the second loaded thickness ($t_{LLD}$) of the lateral region 122 may be approximately 6.5 mm and the second loaded thickness ($t_{LMD}$) of the medial region 133 may be approximately 3 mm. In an example, at approximately T=4.0 s, the medial region 133 and the lateral region 122 may be fully compressed, where the second material of the medial region 122 may operate to compress further than the first material of the lateral region 133 and provide an eversion angle ($a_e$) with respect to the ground surface (G). In an example, the eversion angle ($a_e$) may be approximately 3-30 degrees, 4-15 degrees, 4-10 degrees, or 4-6 degrees.

After approximately T=4.0 s (B), the golfer may begin to unload the foot, and accordingly, the midsole 111 may begin decompressing. For example, the elastic properties of the lateral region 122 may cause the lateral region 122 to decompress to approximately its initial unloaded thickness ($t_{UL}$) by T=4.3 s (C), while the anelastic properties of the medial region 133 may cause the medial region 133 to decompress to approximately 60% of its unloaded thickness ($t_{UM}$). Thus, at approximately T=4.3 s and at roughly cutting plane A-A of the midsole 111, the unloaded thickness ($t_{ULA}$) of the lateral region 122 may be approximately 24 mm and the unloaded thickness ($t_{UMA}$) of the medial region 133 may be approximately 14.5 mm; at roughly cutting plane B-B, the unloaded thickness ($t_{ULB}$) of the lateral region 122 may be approximately 20 mm and the unloaded thickness ($t_{UMB}$) of the medial region 133 may be approximately 12 mm; at roughly cutting plane C-C, the unloaded thickness ($t_{ULC}$) of the lateral region 122 may be approximately 12 mm and the unloaded thickness ($t_{UMC}$) of the medial region 133 may be approximately 7 mm; and at roughly cutting plane D-D, the unloaded thickness ($t_{ULD}$) of the lateral region 122 may be approximately 8 mm and the unloaded thickness ($t_{UMD}$) of the medial region 133 may be approximately 5 mm. In an example, at approximately T=4.3 s, the lateral region 133 may be fully decompressed, where the second material of the medial region 122 may operate to continue to decompress and the eversion angle ($a_e$) may continue to be provided. The eversion angle ($a_e$) may be less at approximately T=4.35 than at T=4.0 s.

At approximately T=8.0 s (B), the golfer may end the unloaded period of the golf swing, and the midsole 111 may be fully decompressed, which may provide a neutral support angle ($a_n$) for the golfer's next step in a walking cycle.

Figure 8:
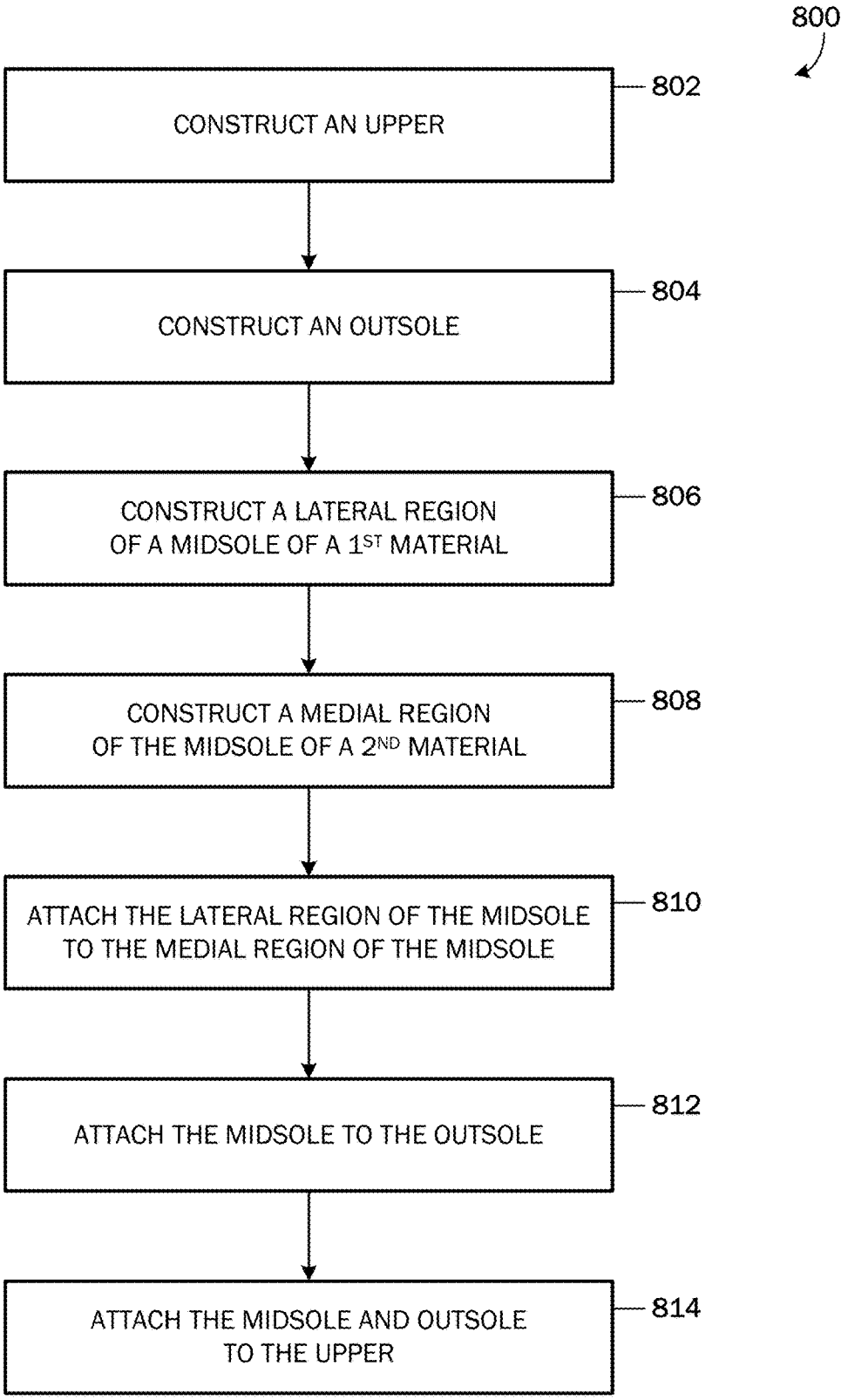
FIG. 8 depicts example operations of a method of making a golf shoe including a regionally time-dependent midsole according to an embodiment.

With reference now to FIG. 8, a flow chart is illustrated having example operations of a method 800 of making a golf shoe 100 including a regionally time-dependent midsole 111 according to an example. For example, the midsole 111 may be constructed to provide a neutral support angle ($a_n$) when a relatively brief compression load is placed on the midsole (e.g., when a golfer is taking a step while walking) and to further provide an everted support angle when the compression load is placed on the midsole for a longer period of time (e.g., when the golfer is swinging a golf club).

At operation 802, an upper 104 may be constructed. For example, the various parts of the upper 104 may be stitched, glued, or otherwise attached together.

At operation 804, an outsole 116 may be constructed. In an example, a TPU mold may be used to form the outsole 116.

At operation 806, the lateral region 122 of the midsole 111 may be constructed. In an example, a first foamed material, which may be a standard firm, relatively to highly elastic foam, such as a firm foamed ethylene vinyl acetate copolymer (EVA) composition, may be placed inside a first mold (e.g., EVA mold) and molded into the lateral region 122. According to an example, the first material may operate to reach maximum compression very quickly (e.g., nearly instantaneously, less than 1 s) when under load.

At operation 808, the medial region 133 of the midsole 111 may be constructed. In an example, a second foamed material, which may be a highly viscous foam, may be placed inside a second mold, such as a memory foam mold and molded into the medial region 133. According to an example, the second material may operate to reach maximum compression at a slower rate than the first foamed material.

At operation 810, the lateral region 122 and the medial region 133 of the midsole 111 may be attached. For example, the lateral region 122 and the medial region 133 may be joined along the knit line 302, which may be vertically blended to the inferior surface (e.g., top surface of the outsole 116) to provide a smooth transition between the lateral region 122 and the medial region 133. According to an example, the lateral region 122 may have a mediolaterally angled joining surface that may be formed to receive an opposing mediolaterally angled joining surface of the medial region 133. In an example, the lateral region 122 and the medial region 133 may be joined by adhesives or other suitable fastening means using standard or non-standard techniques known in the art.

At operation 812, the regionally time-dependent midsole 111 may be attached to the outsole 116. In an example, the midsole 111 may be bonded to the top surface of the outsole 116 using adhesives or other attachment techniques.

At OPERATION 814, the upper 104 constructed at OPERATION 802 may be lasted and attached (e.g., bonded) to the top surface of the midsole 111. In some examples, an insole 126 may be inserted into the shoe 100. In some examples, additional steps may be performed at one or more of the above operations to waterproof the shoe 100, inspect the shoe 100, and/or perform other shoe assembly tasks. According to an aspect, the disparate compression properties of the lateral region 122 and the medial region 133 of the midsole 111 may strategically provide neutral alignment during walking and may evert the wearer's feet at ball address to additionally provide neutral alignment when swinging a golf club. Accordingly, the shoe 100 may be optimized for providing hours of standing comfort and miles of walking comfort and support, while also supporting the golfer's feet throughout a golf swing.

In some examples, the midsole 111 is constructed asymmetrically between a left and a right shoe 100 (e.g., for a righthanded golfer versus a lefthanded golfer). In one example, a pair of shoes 100 is customized for a righthanded golfer, where the right shoe of the pair may include a regionally time-dependent midsole 111 as described herein, and the lateral region 122 and the medial region 133 of the midsole 111 of the left shoe of the pair have the same or similar compression properties. Likewise, a pair of shoes 100 customized for a lefthanded golfer may include a regionally time-dependent midsole 111 in the left shoe of the pair, and the right shoe of the pair may include a midsole 111 with the lateral region 122 and medial region 133 having the same or similar compression properties.

In another example, the midsole 111 may be constructed as an insert for the shoe 100. For instance, the midsole 111 may be inserted and removed from the shoe 100 to allow the golfer to customize whether the left shoe and/or the right shoe of a pair of shoes 100 includes a regionally time-dependent midsole 111 as described herein. In an example, the selection to include the regionally time-dependent midsole 111 in one or both the right and left shoe 100 is based on whether the golfer is a righthanded or lefthanded golfer.

This technology should not be construed as limited to the embodiments set forth herein. Rather, these embodiments are provided so that this disclosure will be thorough and complete, and will fully convey the scope of the technology to those skilled in the art. In the drawings, like numbers refer to like elements throughout. Thicknesses and dimensions of some components may be exaggerated for clarity. The views shown in the Figures are of a right shoe and it is understood the components for a left shoe will be mirror images of the right shoe. It also should be understood that the shoe may be made in various sizes and thus the size of the components of the shoe may be adjusted depending upon the shoe size.

The terminology used herein is for the purpose of describing particular embodiments only and is not intended to be limiting of the technology. As used herein, the singular forms "a," "an," and "the" are intended to include the plural forms as well, unless the context clearly indicates otherwise.

It will be understood that when an element is referred to as being "attached," "coupled" or "connected" to another element, it can be directly attached, coupled or connected to the other element or intervening elements may also be present. In contrast, when an element is referred to as being "directly attached," directly coupled" or "directly connected" to another element, there are no intervening elements present.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present technology are explained in detail in the specification set forth below.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present technology.

It also should be understood the terms, "first", "second", "third", "fourth", "fifth", "sixth", "seventh", "eight", "ninth", "tenth", "eleventh", "twelfth", "top", "bottom", "upper", "lower", "upwardly", "downwardly", "right', "left", "center", "middle", "proximal", "distal", "anterior", "posterior", "forefoot", "mid-foot", and "rear-foot", and the like are arbitrary terms used to refer to one position of an element based on one perspective and should not be construed as limiting the scope of the technology.

All patents, publications, test procedures, and other references cited herein, including priority documents, are fully incorporated by reference to the extent such disclosure is not inconsistent with this technology and for all jurisdictions in which such incorporation is permitted. It is understood that the shoe materials, designs, constructions, and structures; shoe components; and shoe assemblies and sub-assemblies described and illustrated herein represent only some embodiments of the technology. It is appreciated by those skilled in the art that various changes and additions can be made to such products and materials without departing from the spirit and scope of this invention. It is intended that all such embodiments be covered by the appended claims.

What is claimed is:

1. A golf shoe comprising:

an upper; and a sole assembly connected to the upper, the sole assembly comprising:

an outsole; and a midsole having a forefoot area, a rearfoot area, and a midfoot area between the forefoot area and the rearfoot area, and comprising:

a lateral region constructed of a first material positioned at least in the rearfoot area; and a medial region constructed of a second material positioned at least in the rearfoot area, wherein:

the first material compresses to a maximum compression of the first material within a first time period; and the second material compresses to the maximum compression of the first material within the first time period and compresses to a maximum compression of the second material within a second time period, wherein the lateral region is joined at a mediolateral angle to the medial region.

2. The golf shoe of claim 1, wherein the maximum compression of the second material is higher than the maximum compression of the first material.

3. The golf shoe of claim 1, wherein the maximum compression of the first material is in a range of 15%-30% compression of an unloaded thickness of the lateral region.

4. The golf shoe of claim 1, wherein the maximum compression of the second material is in a range of greater than 55% compression of an unloaded thickness of the medial region.

5. The golf shoe of claim 1, wherein the first time period is less than 1 second.

6. The golf shoe of claim 1, wherein the second time period is in a range of 2.5 seconds-6.0 seconds.

7. The golf shoe of claim 1, wherein:

the first material is an elastic material longitudinally traversing the length of the lateral region of the sole; and the second material is a viscoelastic material longitudinally traversing the length of the medial regional of the sole.

8. The golf shoe of claim 1, wherein:

the first material decompresses to an unloaded thickness of the lateral region within a third time period; and the second material decompresses to an unloaded thickness of the medial region within a fourth time period, wherein the fourth time period is longer than the third time period.

9. A regionally time-dependent midsole for a golf shoe, the midsole having a forefoot area, a rearfoot area, and a midfoot area between the forefoot area and the rearfoot area, and comprising:

a lateral region constructed of a first material positioned at least in the rearfoot area and in the forefoot area; and a medial region constructed of a second material positioned at least in the rearfoot area and forefoot area, wherein when the midsole is under a load:

the lateral region compresses to a maximum compression of the first material and the medial region compresses to the same maximum compression of the first material within a first time period; and the medial region compresses to a maximum compression of the second material within a second time period, wherein the lateral region is joined at a mediolateral angle to the medial region.

10. The midsole of claim 9, wherein:

the maximum compression of the second material is higher than the maximum compression of the first material; and the second time period is longer than the first time period.

11. The midsole of claim 9, wherein the midsole is configured so that an everted support angle is formed relative to a ground surface when the midsole is on the ground surface and under the load for the second time period.

12. The midsole of claim 9, wherein:

the first material is an elastic foam material; and the second material is a viscous foam material.

13. The midsole of claim 9, wherein the midsole is configured so that a neutral support angle is formed by the midsole relative to a ground surface when the midsole is on the ground surface and the lateral region and the medial region compress to the maximum compression of the first material within the first time period.

14. The midsole of claim 9, wherein:

the first material decompresses to an unloaded thickness of the lateral region within a third time period; and the second material decompresses to an unloaded thickness of the medial region within a fourth time period, wherein the fourth time period is longer than the third time period.

15. A method for making the golf shoe of claim 1, the method comprising:

constructing the upper;

constructing the outsole;

constructing the lateral region of the midsole using the first material;

constructing the medial region of the midsole using the second material, wherein the maximum compression of the second material is higher than the maximum compression of the first material;

attaching the lateral region to the medial region of the midsole;

generating a sole assembly by attaching the midsole to the outsole; and attaching the upper to the sole assembly.

16. The method of claim 15, wherein:

the first material is in a range of 15%-30% compression of an unloaded thickness of the lateral region; and the maximum compression of the second material is in a range of greater than 55% compression of an unloaded thickness of the medial region.

17. The method of claim 15, wherein attaching the lateral region to the medial region of the midsole comprises joining the lateral region to the medial region at the mediolateral angle.

18. The method of claim 15, wherein:

the first material decompresses to an unloaded thickness of the lateral region within a third time period; and the second material decompresses to an unloaded thickness of the medial region within a fourth time period, wherein the fourth time period is longer than the third time period.

* * * * *